US005316407A

United States Patent [19]

Miller

[11] Patent Number: 5,316,407

[45] Date of Patent: May 31, 1994

[54] MANHOLE COVER SUPPORT

[76] Inventor: Wayborn M. Miller, 3104 Sanderson Rd., Knoxville, Tenn. 37921

[21] Appl. No.: 914,267

[22] Filed: Jul. 15, 1992

[51] Int. Cl.[5] ..... E02D 29/14

[52] U.S. Cl. ..... 404/25; 52/20

[58] Field of Search ..... 404/25, 26; 52/20, 19

[56] References Cited

U.S. PATENT DOCUMENTS

| | | | |
|---|---|---|---|
| 1,172,905 | 1/1915 | Ricketts | 404/22 |
| 1,908,909 | 5/1933 | Manz . | |
| 3,858,998 | 1/1975 | Larsson et al. | 52/19 X |
| 3,891,337 | 6/1975 | McCoy . | |
| 3,969,847 | 7/1976 | Campagna et al. | 52/19 X |
| 4,097,171 | 6/1978 | Fier | 404/26 |
| 4,302,126 | 11/1981 | Fier . | |
| 4,582,450 | 4/1986 | Neil | 52/20 X |
| 4,867,600 | 9/1989 | Bowman . | |
| 4,867,601 | 9/1989 | Bowman . | |
| 4,872,780 | 10/1989 | Bowman | 52/20 X |
| 4,966,489 | 10/1990 | Bowman . | |
| 4,969,771 | 11/1990 | Bowman | 52/20 X |

*Primary Examiner*—Ramon S. Britts
*Assistant Examiner*—James A. Lisehora
*Attorney, Agent, or Firm*—Michael E. McKee

[57] ABSTRACT

A manhole cover support cooperable with a manhole frame for raising the elevation of a manhole cover utilizes a gapped support body positionable between the frame and the manhole cover and size-adjustment mechanisms for altering the size of the outer periphery of the support body. The support body includes one section disposed on one side of its gap and another section disposed on the opposite side of its gap, and the size-adjustment mechanisms include a threaded shank attached to the one section of the support body so as to extend across the gap provided therein. The size-adjustment mechanisms also include a U-shaped bracket attached to the another section of the support body so that the portion of the threaded shank which extends across the gap is accepted by the U of the U-shaped bracket and further includes a nut threaded upon the shank so as to be disposed between the attached end of the shank and the bracket. By rotating the nut about the shank so that the bracket is moved away from the attached end of the shank by the nut, the outer dimensions of the support body are increased. The inside surface of the U of the U-shaped bracket is shaped to accommodate a shifting of the shank relative thereto in a manner which reduces the exposure of the bracket and shank to undue strain from one another.

21 Claims, 4 Drawing Sheets

MANHOLE COVER SUPPORT

BACKGROUND OF THE INVENTION

This invention relates generally to manhole cover supports and relates, more particularly, to means by which a manhole cover may be elevated with respect to an underlying support frame to compensate for a rise in the elevation of a roadway such as may occur during a resurfacing of the roadway.

It is known that manhole covers which normally rest upon a frame embedded within a roadway may be raised in relation to the frame by positioning an intermediate support between the frame and the cover. Such an intermediate support is commonly adapted to rest upon the frame in place of the manhole cover and has a surface upon which the manhole cover can be positioned. Examples of such intermediate supports are shown and described in U.S. Pat. Nos. 3,891,337, 4,582,450 and 4,867,601.

It is an object of the present invention to provide a new and improved manhole cover support of the aforedescribed class.

Another object of the present invention is to provide such a support having outer dimensions which can be readily adjusted to secure the support tightly within the manhole frame or loosen the support from the frame for removal.

Still another object of the present invention is to provide such a support which cooperates with a layer of roadway material placed around the support during a resurfacing operation in a manner which enhances the securement of the support within the roadway.

Yet another object of the present invention is to provide such a support which can be secured tightly within the manhole frame by a single nut-rotating operation.

A further object of the present invention is to provide such a support which is uncomplicated in construction and effective in operation.

SUMMARY OF THE INVENTION

This invention resides in a manhole cover support cooperable with a manhole frame having an upwardly-opening recess within a manhole cover is positionable for supporting the manhole cover in an elevated condition with respect to the frame.

The manhole cover support includes a support body receivable by the upwardly-opening recess of a manhole frame and having a central access opening and a gap extending between the central access opening and the outer periphery of the support body so that one section of the support body is disposed on one side of the gap and another section of the support body disposed on the opposite side of the gap. The support also includes means for adjusting the outer dimensions of the support body including an elongated shank associated with the one section of the support body and having two opposite end portions and means attached to the another section of the support body providing a passageway opening generally toward said one section. One end portion of the shank is fixedly attached to the one section of the support body, and the other end portion of the shank is externally-threaded along at least a segment of its length and is received by the passageway of the passageway-providing means. A rotatable body having an internally-threaded opening is threaded upon the externally-threaded segment of the other end portion of the shank and disposed generally between the one end portion of the shank and the passageway-providing means so by rotating the rotatable body about the externally-threaded segment of the shank end portion so as to move the passageway-providing means along the length of the shank and generally away from the one shank end portion, the outer dimensions of the support body are increased. In addition, the passageway of the passageway-providing means is adapted to accommodate a shift in position of the other end portion of the shank relative to the passageway as the outer dimensions of the support body are increased.

DETAILED DESCRIPTION OF AN ILLUSTRATED EMBODIMENT

Figure 1:
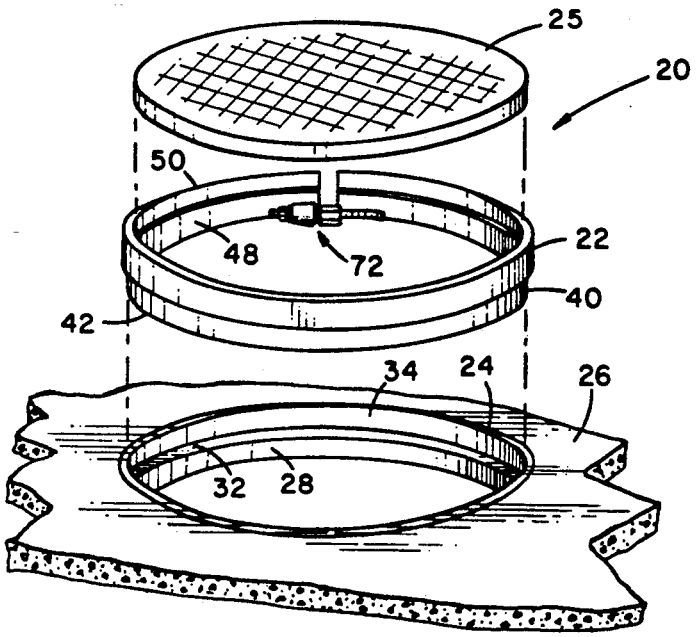
FIG. 1 is a perspective view, shown exploded, of an environment within which an embodiment of a manhole cover support is utilized.

Turning now to the drawings in greater detail, there is illustrated in FIG. 1 an environment 20 within which an embodiment of a manhole cove support 22 is intended to be used. The environment 20 includes frame 24 embedded within a layer 26 of a roadway surfacing material, such as asphalt, and including a central access opening 28 and a cover-accepting recess 30. The recess 30 includes a substantially planar bottom, or sill surface 32, and sidewalls 34. Before a roadway layer 26 is resurfaced, as shown in FIG. 1, the cover 25 is positioned within the recess 30 of the frame 24 so that the upper surface of the cover 25 is substantially even with, or corresponds with, the level of the upper surface of the roadway. Accordingly, the recess 30 is sized to accept the cover 25 when positioned therein. In this connection, the diameter of the frame sidewalls 34 is slightly larger than that of the cover 25, and the sill surface 32 is sized to stably support the cover 25 when positioned thereon.

Figure 2:
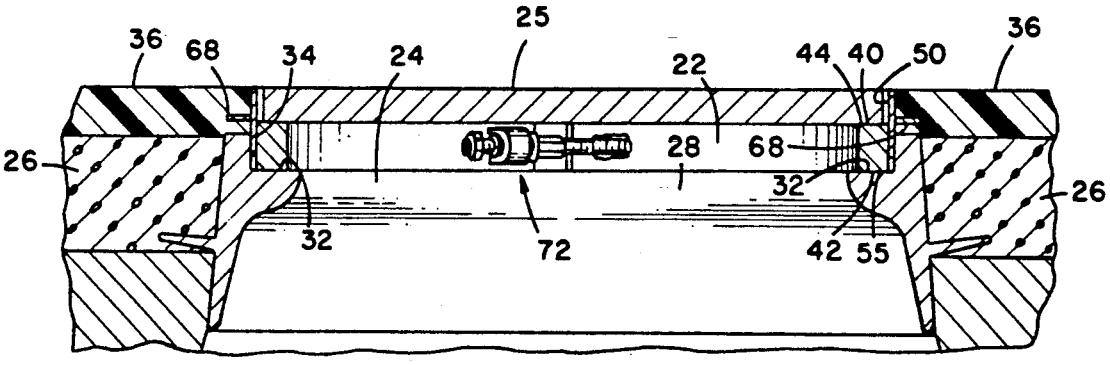
FIG. 2 is a transverse-cross sectional view of the FIG. 1 environment, when assembled and embedded within a resurfaced roadway.

As will be apparent herein, the support 22 is positionable within the recess 30 of the frame 24 as shown in FIG. 2 for supporting the cover 25 at a higher grade or elevation if, for example, the roadway layer 26 is overlain by another layer 36 of roadway material so that the grade or elevation of the roadway is raised by the additional layer 36.

In the depicted environment 20, the frame 24 and the cover 25 are circular in form. However, it will be understood that a support in accordance with the broader aspects of the present invention may be utilized with a frame and manhole cover of alternative configurations, such as a rectangular form. Accordingly, the principles of the present invention may be variously applied.

Figure 3:
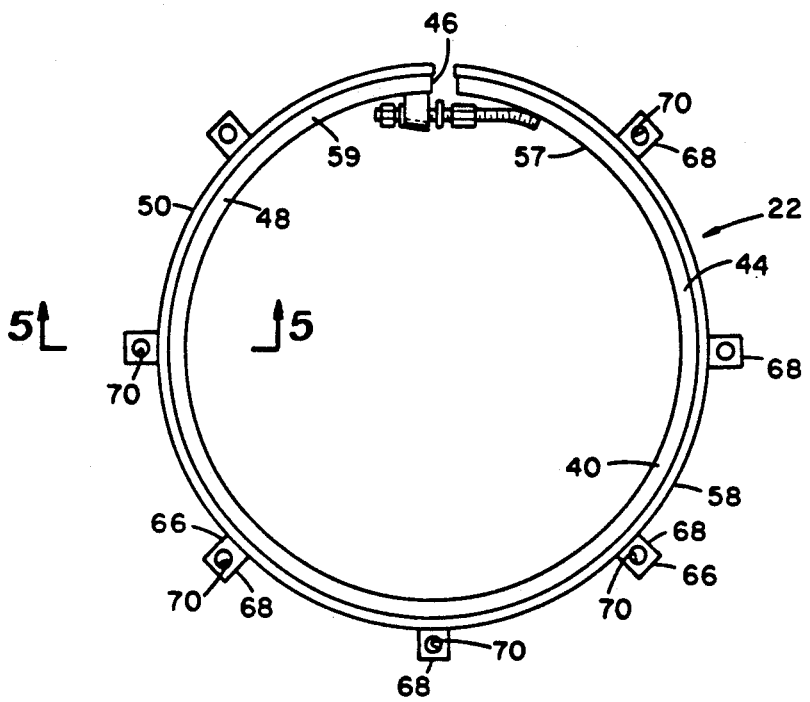
FIG. 3 is a plan view of the support of FIG. 1.
Figure 4:
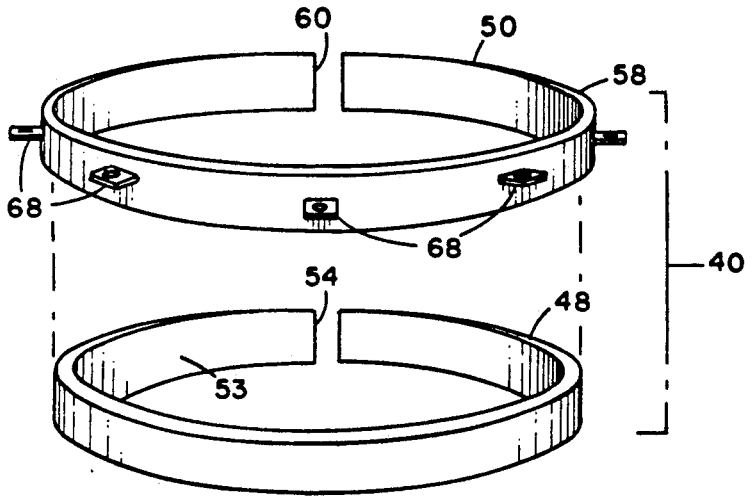
FIG. 4 is a perspective view of the support body of the FIG. 1 support, shown exploded.
Figure 5:
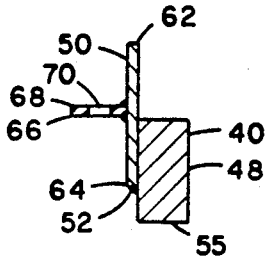
FIG. 5 is a cross-sectional view taken along line 5—5 of FIG. 3.

With reference to FIGS. 2–5, the support 22 includes a ring-like body 40 having a planar bottom 42 and a recess 44 for accepting the cover 25 when positioned therein and a gap 46 accommodating a change in size of the outer periphery, i.e., an increase or decrease in the diameter, of the body 40. As best shown in FIG. 2, the gap 46 separates the support body 40 along one side thereof so that one section, indicated 57, of the support body 40 is disposed on one side of the gap 46 and another section, indicated 59, of the support body 40 is disposed on the opposite side of the gap 46. In the depicted support 22, the body 40 includes a ring 48 and a keeper 50 fixedly joined to the ring 48 along the outside surface thereof. The ring 48 and keeper 50 are constructed of metal, such as A-36 steel, and are attached to one another with welds 52 (FIG. 5). If desired, the keeper 50 may be coated with a galvanizing material.

As best shown in FIG. 4, the ring 48 has a central access opening 53 positionable in registry with the access opening 28 of the frame 24 and has a slit 54 which corresponds with the gap 46 (FIG. 3) of the body 40. Furthermore, the ring 48 is substantially rectangular in cross-section, as best shown in FIG. 5, and has a bottom 55 which provides the bottom 42 of the support body 40. The bottom 55 of the ring 48 is oriented in a plane so that when the support 24 is positioned within the frame recess 30, the bottom 55 lies flat upon the sill surface 32 as shown in FIG. 2. By way of example, the ring 48 may possess a height between about 0.625 and 1.0 inches, but the height of the ring 48 is normally sized for a preselected application.

With reference again to FIGS. 3–5, the keeper 50 of the support 24 includes a strip 58 extending an appreciable distance around the outside surface of the ring 48 and forming a slit 60 which corresponds with the gap 46 of the support body 40. By way of example, the keeper strip 58 may possess a thickness within a gauge range of about ten gauge to fourteen gauge. During use of the support 24, the keeper 50 prevents material of the added layer 36 (FIG. 2) of roadway material from entering the access opening 28 of the frame 24. Accordingly, the keeper 50 is affixed about the ring 48 so its upper edge, indicated 62 in FIG. 5, is substantially even with the raised elevation or grade of the roadway when resurfaced with the additional layer 36.

The height of the keeper strip 58 as measured between its upper edge 62 and lower edge 64, as viewed in FIG. 5, may be any height within a relatively large range of heights, and the keeper 50 is preferably positioned about the ring 48 so that its lower edge 64 does not extend below the bottom 55 of the ring 48 to accommodate a welding of the lower edge 64 of the keeper 50 to the outside surface of the ring 48. If desired, the keeper strip 58 can be provided with a preselected height prior to attachment of the strip 58 to the ring 48 and simply shifted upwardly or downwardly along the outside surface of the ring 48 for attachment thereto at a predetermined location therealong so that when the support 22 is positioned within the manhole frame 24, the upper edge 62 of the keeper 50 is positioned so as to correspond with the expected rise in elevation of the roadway adjacent the frame 24.

As mentioned earlier, the support 22 can be accepted by the cover-accepting recess 30 of the frame 24. Accordingly, when the body 40 of the support 22 is in an undeformed condition, i.e., neither expanded nor contracted in size, the overall diameter of the body 40 as measured through the center, indicated 65 in FIG. 3, of the body 40 and across the keeper 50 is slightly smaller than that of the frame recess 30 for ease of acceptance of the body 40 by the recess 30.

It is a feature of the support 22 that its body 40 includes outwardly-extending protuberances 66 capable of being embedded within the layer 36 of roadway material when the layer 36 is positioned about the body 40. In the depicted support 22, the protuberance 66 are provided by a plurality of steel retainer tabs 68 attached, as with welds, to the outside surface of the keeper 50 so as to extend radially outwardly of the keeper 50. The tabs 68 are substantially flat in shape and regularly spaced about the keeper 50 so as to be oriented within a common plane. An aperture 70 is provided within each tab 68 as shown in FIG. 3 for accepting an amount of roadway material spread thereover. Once embedded within the layer 36 of roadway material, as shown in FIG. 2, so that an amount of roadway material is accepted by the tab apertures 70, the tabs 68 enhance the securement of the support 22 within the frame 24 when exposed to forces which would otherwise loosen or dislodge the support 22 and help to retain the support body 40 in its enlarged condition. A tab 68 found to be well-suited for use as the protuberance 66 is constructed of sixteen gauge steel, measures about 1.25 inches along each of its edges, and has an aperture 70 with a diameter of about 0.75 inches.

Figure 6:
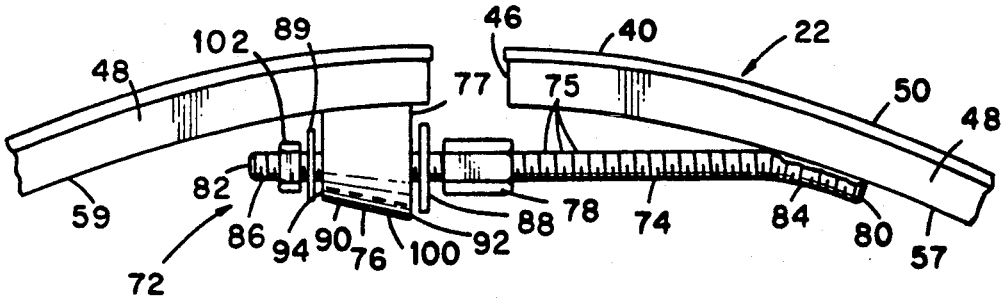
FIG. 6 is a view similar to that of FIG. 3 of a fragment of the FIG. 1 support drawn to a slightly larger scale.
Figure 7:
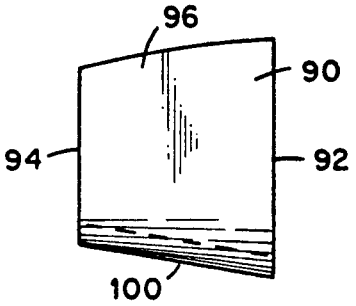
FIG. 7 is a side view of a component of the size-adjustment means of the FIG. 1 support.

With reference to FIGS. 6–9, the support 24 also includes means, generally indicated 72, for adjusting the diameter of the ring-like body 40 by increasing the separation between the sections 57 and 59 of the support body 40. In the depicted support 22, the size-adjustment means 72 includes an elongated shank 74, passageway-providing means 76 and an internally-threaded body, such as a nut 78. As best viewed in FIG. 6, the shank 74 includes two opposite ends 80, 82 and two end portions 84, 86 adjacent the ends 80, 82, respectively. The end portion 84 of the shank 74 is bent into an arcuate form so that when positioned against the inside surface of the section 57 of the support body 40 as shown in FIG. 6, the shape of the end portion 84 generally conforms with the curvature of the inside surface of the ring 48 and so that the opposite shank end portion 86 extends generally across the gap 46 to a location adjacent the other section 59 of the support body 40. The depicted shank 74 is also externally-threaded so as to include threads 75 which spiral along the full length of the shank 74 and is constructed, for example, of coated or stainless steel. A shank found to be well-suited as the shank 74 may possess a diameter within the range of about 0.375 to 0.625 inches.

Figure 8:
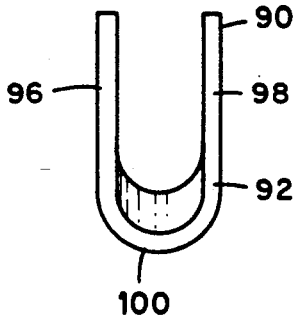
FIG. 8 is an end view of the component of FIG. 7 as seen from the right in FIG. 7.
Figure 9:
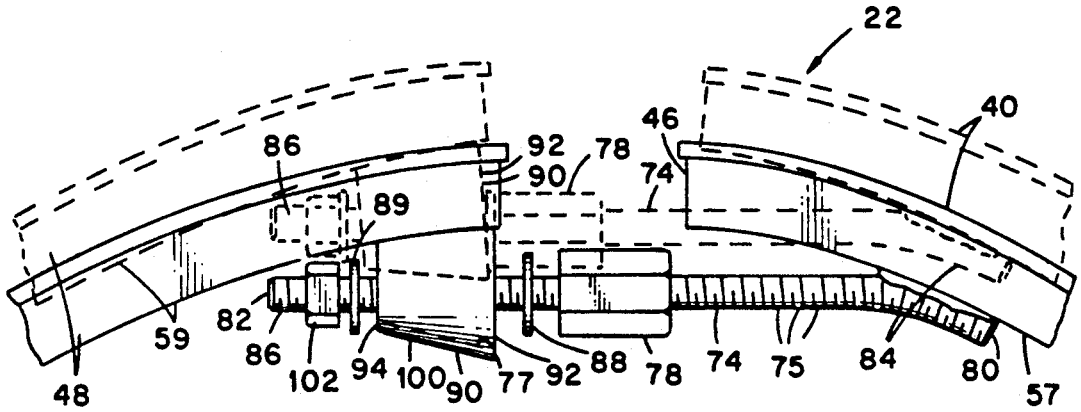
FIG. 9 is a view similar to that of FIG. 4 illustrating the relative positions of the size-adjustment means of the FIG. 1 support as the outer dimensions of the support body are altered.

The passageway-providing means 76 is in the form of a steel bracket 90 having two opposite ends 92, 94 and is generally U-shaped in cross-section, as viewed in FIG. 8, so as to provide the bracket 90 with two legs 96, 98 and a bridge 100 joining the legs 96, 98. The legs 96, 98 are positioned against the inside surface of the ring 48 as shown in FIG. 6 and attached thereto with welds so that the bracket 90 and inside surface of the ring 48 cooperate to provide a tunnel, or passageway 77, through which the shank end portion 86 extends. As will be apparent herein, the bracket end 92 provides an entrance for the passageway 77, and the bracket end 94 provides an exit for the passageway 77.

The nut 78 is threaded upon the shank 74 as shown in FIG. 6 and disposed generally between the end 92 of the bracket 9 and the attached end 80 of the shank 74. As will be apparent herein, the size of the outer periphery of the support body 40 is increased by rotating the nut 78 in an appropriate direction about the shank 74 so that the nut 78 is urged against the end 92 of the bracket 90 so as to move the bracket 90 along the length of the shank 74. If desired, a washer 88 may be positioned about the shank 74 and between the nut 78 and bracket end 92 for distributing the forces exerted by the nut 78 across the bracket end 92.

With reference still to FIG. 6, a second internally-threaded body, such as a nut 102, is threaded upon the shank end portion 86 adjacent the shank end 84 so as to be disposed generally between the shank end 84 and the end 94 of the bracket 90. As will be apparent herein, the nut 102 is tightenable against the bracket end 92 to prevent undue shifting or movement of the body sections 57 and 59 during shipping and handling. In addition, while the nut 78 is in a loosened condition, i.e., spaced from the bracket end 94, the nut 102 can be rotated about the shank 74 and urged against the bracket end 94 to thereby decrease the size of the outer periphery of the support body 40. If desired, a washer 89 may be positioned about the shank 74 and between the nut 102 and bracket end 94 for distributing the forces exerted by the nut 102 across the bracket end 94.

When assembling the aforediscussed components of the size-adjustment means 72, the nut 78 is threaded upon the shank 74 and the washer 89 is positioned about the shank 74 so that the nut 78 and washer 89 are located substantially midway between the shank ends 80, 82 and the nut 102 is threaded upon the shank 74 and the washer 89 is positioned upon the shank ? 4 so that the nut 102 and washer 89 are positioned adjacent the shank end 82. The shank 74 is thereafter positioned within the ring 48 so that the end portion 84 of the shank 74 engages the support body section 57 as shown in FIG. 6 so that the shank end portion 86 spans the gap 46 and is disposed adjacent the support body section 59. The shank end portion 84 is then welded to the inside surface of the ring 48 to secure the shank 74 thereto. The bracket 90 is subsequently positioned about the shank end portion 86 and between the washers 88, 89 so that the end portion 86 is accepted by the U of the bracket 90 and the bracket 90 is disposed so that the bracket end 92 generally faces the support body section 57. The legs 96, 98 of the bracket 90 are then positioned against and welded to the inside surface of the ring 48 as shown in FIG. 6.

With the cover 25 removed from the recess 30 of the manhole frame 22, the support 22 is installed within the frame 24 by positioning the support body 40 of the support 22 within the frame recess 30 so that the bottom 42 of the support body 40 rests flatly upon the sill surface 32 of the frame 24, as shown in FIG. 2. The nut 102, which is likely to be in a tightened condition against the bracket end 92 for shipping or handling of the support 22, is then rotated with a suitable tool (not shown) about the shank end portion 86 to space the nut 102 an appreciable distance along the shank 74 from the bracket end 94 The nut 78 is then rotated with a tool about the shank 74 so that the bracket 90 is forcibly urged along the shank 74 away from the shank end 80. It follows that as the bracket 90 is urged away from the shank end 80, the separation between the support body sections 57 and 59 at the gap 46 is increased so that the dimensions, e.g., the diameter, of the outer periphery of the support body 40 is increased. The diameter of the support body 40 continues to be increased as the nut 78 continues to be rotated until the body 40 is tightened against the sidewalls 34 of the frame recess 30.

When tightened within the recess 30, the resulting frictional engagement between the outside surface of the support body 40 and the sidewalls 34 of the frame recess 30 resists dislodgement of the support 22 from the frame 24. If it is desired that the support 22 be removed from the frame 24, the nut 78 is initially rotated with a tool about the shank 74 to a loosened condition, i.e., to a position spaced from the bracket end 92, and then the nut 102 is rotated about the shank 74 to forcibly urge the bracket 92 along the shank 74 and toward the shank end 80 so that the dimensions, e.g., the diameter, of the outer periphery of the support body 40 is decreased to the degree necessary to accommodate removal of the support 22 from the frame 24.

As the separation of between the body sections 57 and 59 is increased at the gap 46 during a size-adjusting operation, the body sections 57 and 59 shift in position relative to one another. As a consequence of the shift in position of the body sections 57 and 59, the shank 74 tends to shift in position relative to the bracket 90. More specifically and with reference to FIG. 9, as the separation between the body sections 57 and 59 is increased, the shank end portion 86 tends to shift radially outwardly with respect to the shank end portion 84 from its position illustrated in solid lines in FIG. 9 to, for example, its position illustrated in phantom in FIG. 9. It is a feature of the support 40 that its bracket 90 accommodates this aforementioned shift of the shank end portion 86. To this end, the opening of the U of the bracket 90 is greater at its end 92 than it is at its end 94 so that when attached to the inside surface of the support body section 59, the inside surface of the bridge 100 is canted with respect to the longitudinal axis of the shank end portion 86 as shown in FIG. 6. The passageway 77 provided by the U of the bracket 90 and the inside surface of the support body 40 is therefore larger at the bracket end 92 than it is at the bracket end 94. 10 As the separation between the support body sections 57 and 59 is increased, the inside surface of the bridge 100 and the longitudinal axis of the shaft end portion 84 converge from a canted, or a FIG. 9 solid-line, relationship toward a parallel relationship. Furthermore, because the opening of the U of the bracket 90 is relatively large at its end 92 in relation to its end 94, the support body sections 57 and 59 may be separated, or spread apart, by an appreciable amount before the end 92 of the bracket 90 is moved into contact with the shank end portion 86 at the bridge 100. Such a feature is advantageous in that it prevents exposure of the bridge 100 of the bracket 90 to undue strain from the shank 74, which strain would otherwise result if the shank 74 were to bear against the bracket bridge 100 at the bracket end 92 as the shank 74 is slidably moved therealong between its FIG. 9 solid-line and phantom-line positions.

Figure 10:
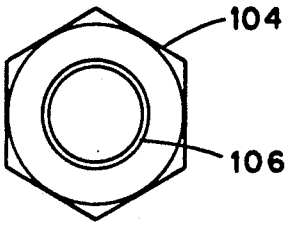
FIG. 10 is a plan view of a nut for use in another embodiment of a manhole cover support.

It will be understood that numerous modifications and substitutions can be had to the aforedescribed embodiment without departing from the spirit of the invention. For example, although the nut 102 of the support 22 has been shown and described as cooperable with the external threads 75 of the shank 7 to decrease the size of the outer periphery of the support body 40 when the nut 102 is rotated about the shank 74 and urged against the bracket 90 an alternative embodiment of the support may utilize an alternative form of a nut. For example, there is illustrated in FIG. 10 a break-away nut 104 which could be substituted for the nut 102 of the support 22 and which has threads 106 which are adapted to strip about the threads 75 of the shank 74 when the bracket 90 is urged against the nut 104 (by means of the nut 78) so that after its threads 106 are stripped, the nut 104 offers little or no resistance to the continued advancement of the bracket 90 along the shank 74 from the shank end portion 34. Such a break-away nut 104 may be desired in an application in which the size of the outer periphery of the body of the support need not be decreased for removal from the manhole frame, once the support is positioned therein, and the break-away nut 104 provides an advantage in that only one nut-rotating operation, i.e., that involving the nut 78, would be required to tightly secure the body of the support within the frame sidewalls 34. The nut 104 may be constructed out of any of a number of relatively soft materials such as soft aluminum, brass, plastic, zinc or lead, but in any event would possess weaker threads than those of the shank 74 and nut 78.

Figure 11:
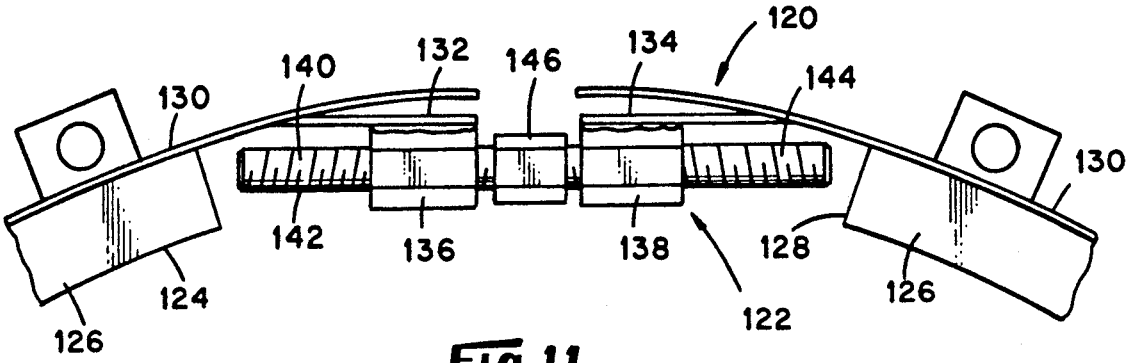
FIG. 11 is a top plan view of a fragment of another embodiment of a manhole cover support.
Figure 12:
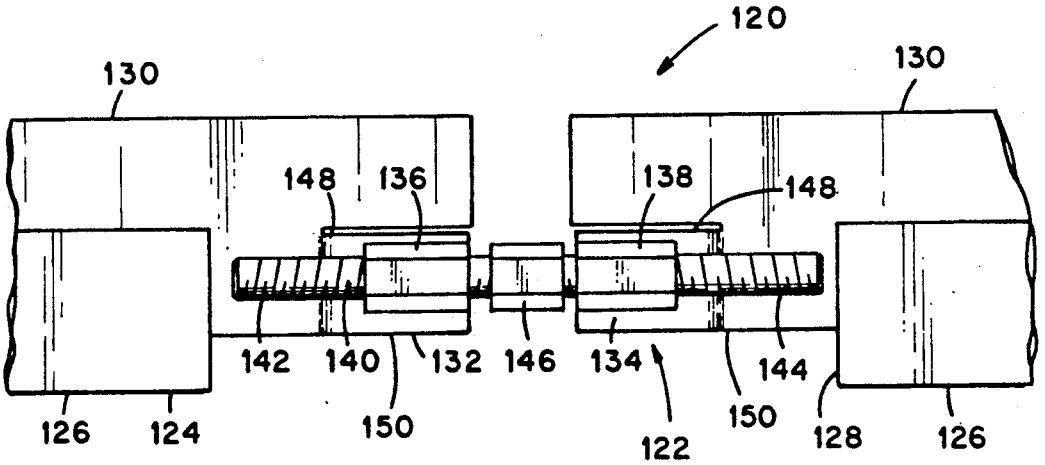
FIG. 12 is an elevational view of the fragment of FIG. 10 as viewed from below in FIG. 10.

Still further, there is illustrated in FIGS. 11 and 12 another embodiment 120 of a support which utilizes a turnbuckle assembly 122 for increasing the outer dimensions of the support 120. This support 120 has a support body 124 including a ring 126 having a gap 128 and a keeper strip 130 affixed about the ring 126 so that one section, indicated 132, of the keeper strip 130 extends across a portion of the gap 128 and another section, indicated 134, of the keeper strip 130 extends across a portion of the gap 128. The turnbuckle assembly 122 includes a first nut 136 welded to the inside surface of the keeper strip section 132 a second nut 138 welded to the inside surface of the keeper strip section 134, and a shank 140 having threaded portions 142, 144 at opposite ends of the shank 140. The shank 140 also includes a collar 146 intermediate its threaded end portions 142, 144 enabling the shank 140 to be rotated with a wrench. Each of the threaded shank end portions 142, 144 is threadably received by a corresponding nut 136 or 138 so that the shank 140 and nuts 136, 138 are arranged in a substantially linear arrangement. To this end, the keeper strip portions 132, 134 are bent radially inwardly of the circular path along which the remaining, or major section, of the keeper strip 130 extends.

It is a feature of the support 120 that upon rotation of the shank 140 in one rotational direction with respect to the nuts 136, 138, the nuts 136, 138 are moved farther apart to thereby increase the outer dimensions of the support 120, and upon rotation of the shank 140 in the opposite rotational direction with respect to the nuts 136, 138 moves the nuts 136, 138 are moved toward one another to thereby decrease the outer dimensions of the support 120. To this end, the threads of the nut 136 are left-handed, the threads of the nut 138 are right-handed and the threads of the shank end portions 132, 134 are left-handed and right-handed, respectively, so that the shank 140 cooperates with the threads of the nuts 136, 138 in the aforedescribed manner. Furthermore, the material and size of the keeper strip 136, e.g. Steel, accommodates a deformation of the keeper strip sections 132, 134 adjacent each bend therein as the outer dimensions of the support 120 are increased or decreased as aforedescribed. In this connection, the height of each keeper strip section 132 or 136 as measured between its upper and lower edges, indicated 148 and 150, respectively, in FIG. 12, is relatively small, e.g. about 1.5 inches, and the thickness of each keeper strip section 132 or 136 is no greater than a thickness corresponding with about fourteen gauge.

Accordingly, the aforedescribed embodiment is intended for the purpose of illustration and not as limitation.

What is claimed is:

1. A manhole cover support cooperable with a manhole frame having an upwardly-opening recess within which a manhole cover is positionable for supporting the manhole cover in an elevated condition with respect to the frame, the manhole cover support comprising:

a support body receivable by the upwardly-opening recess of a manhole frame and having a central access opening and a gap extending between the central access opening and the outer periphery of the support body so that one section of the support body is disposed on one side of the gap and another section of the support body is disposed on the opposite side of the gap; and means for adjusting the outer dimension of the support body including:

a) an elongated shank having a length and being associated with the one section of the support body and having two opposite end portions;

b) means attached to the another section of the support body providing a passageway opening generally toward said one section, one end portion of the shank being fixedly attached to said one section so that the shank is thereby prevented from moving relative to the one section and the other end portion of the shank being externally-threaded along at least a segment of its length and being received by the passageway of the passageway-providing means; and c) a rotatable body having an internally-threaded opening threaded upon the externally-threaded segment of said other end portion of the shank and disposed generally between said one end portion of the shank and the passageway-providing means so that by rotating the rotatable body about said other end portion of the shank so as to act upon and thereby move said passageway-providing means along the length of the shank and generally away from said one shank end portion, the outer dimensions of the support body are increased, and the passageway of the passageway-providing means is adapted to accommodate a shift in position of said other end portion of the shank relative to the passageway in a direction substantially perpendicular to the length of the shank as the outer dimensions of the support body are increased and as the shank is prevented from moving relative to the one section of the support body.

2. The support as defined in claim 1 wherein the rotatable body is a nut which is tightenable against the passageway-providing means as the nut is rotated about said other end portion of the shank for increasing the outer dimensions of the support body as aforesaid.

3. The support as defined in claim 1 wherein the passageway of the passageway-providing means has an entrance and an exit, and the entrance of the passageway is larger than that of the exit to accommodate a shift in position of said other end portion of the shank across the entrance.

4. The support as defined in claim 1 wherein the passageway of the passageway-providing means has an entrance through which said other end portion of the shank extends and the passageway-providing means includes an abutment surface adjacent the passageway entrance, and the abutment surface is adapted to receive forces exerted upon the passageway-providing means by the rotatable body as the rotatable body is rotated about said other end portion of the shank for increasing the outer dimensions of the support body as aforesaid.

5. The support as defined in claim 1 wherein said another section of the support body includes a surface which faces generally inwardly of the support body, the passageway-providing means includes a generally U-shaped bracket having two legs and a bridge joining the two legs, and the legs of the U-shaped bracket are fixedly secured to said surface of the support body so that the passageway is collectively provided by the interior of the U of the U-shaped bracket and said surface of the support body.

6. The support as defined in claim 5 wherein the passageway provided by the U-shaped bracket and the inside surface of the support has an entrance which generally faces the rotatable body, the rotatable body and passageway cooperate with one another to effect a movement of said other end portion of the shank across a portion of the passageway entrance as the passageway-providing means is moved by the rotatable body along the length of the shank, and the passageway entrance is sized to accommodate the movement of said other end portion of the shank across the passageway entrance.

7. The support as defined in claim 6 wherein the passageway has an exit opposite the entrance thereof, and the bridge of the U-shaped bracket has an inside surface which is substantially linear as a path is traced between the entrance and the exit of the passageway, and the inside surface of the bridge is disposed in a canted relationship with respect to the longitudinal axis of said other end portion of the shank so that movement of said other end portion of the shank across the passageway entrance effects a convergence of the inside surface of the bracket and the longitudinal axis of said other end portion of the shank toward a parallel disposition.

8. The support as defined in claim 1 wherein the support body includes a ring having a slit along one side thereof which corresponds with the gap of the support body and further includes a keeper strip secured to the outside surface of the ring so as to extend an appreciable distance therearound, and the keeper strip has a slit which corresponds with the gap of the support body.

9. The support as defined in claim 1 for use with a manhole frame embedded within a roadway wherein the support body includes at least one protuberance extending generally outwardly thereof and adapted to be embedded within roadway material place about the support body during a resurfacing operation so that the securement of the support body within the manhole frame is enhanced.

10. The support as defined in claim 9 wherein the protuberance includes an aperture therein for accepting roadway material placed about the support body during a resurfacing operation.

11. The support as defined in claim 1 wherein the passageway has an entrance which opens generally toward said one end portion of the shank and an exit opposite the entrance, said other end portion of said shank has a part which protrudes out of the passageway through said exit and the support further comprises a nut threaded upon said part of said other end portion of the shank and cooperable with the passageway-providing means so that the passageway-providing means is adapted to accept forces exerted by said nut as said nut is rotated in a direction about said other end portion of the shank so as to urge the passageway-providing means along the length of the shank and generally toward said one end portion of the shank.

12. The support as defined in claim 11 wherein the nut is a break-away nut having threads which are adapted to strip about the threads of said other end portion of the shank when the passageway-providing means is forced against the break-away nut by the rotatable body.

13. A manhole cover support for use with a manhole frame having an upwardly-opening recess within which a manhole cover is positionable, the manhole cover support comprising:

a support body receivable by the upwardly-opening recess of a manhole frame and having an outer periphery and a gap which separates the support body at the outer periphery; and size-adjustment means associated with the support body for adjusting the dimensions of the outer periphery of the support body including a) a threaded shank having a length and being fixedly attached at one end to one section of the support body disposed on one side of the gap so that the shank is thereby prevented from moving relative to the one section;

b) means attached to another section of the support body disposed on the opposite side of the gap providing a passageway which accepts a portion of the threaded shank; and c) a nut threaded upon the threaded shank and disposed generally between the attached end of the shank and the passageway-providing means so that by rotating the nut about the shank so that the passageway-providing means is acted upon by the nut and urged along the length of the shank in the direction opposite the fixed end of the shank, the dimensions of the outer periphery of the support body are increased, the nut and passageway-providing means cooperate with one another to effect a shifting in position of the threaded shank across the passageway in a direction substantially perpendicular to the length of the shank as the nut is rotated about the shank as aforesaid and the shank is prevented from moving relative to the one section of the support body.

14. The support as defined in claim 13 wherein said another section of the support body includes a surface which faces generally inwardly of the support body, the passageway-providing means includes a generally U-shaped bracket having two legs and a bridge joining the two legs, and the legs of the U-shaped bracket are fixedly secured to said surface of the support body so that the passageway is collectively provided by the interior of the U of the U-shaped bracket and said surface of the support body.

15. The support as defined in claim 13 wherein the support body includes a ring having a slit along one side thereof which corresponds with the gap of the support body and further includes a keeper strip secured to the outside surface of the ring so as to extend an appreciable distance therearound, and the keeper strip has a slit which corresponds with the gap of the support body.

16. The support as defined in claim 13 for use with a manhole frame embedded within a roadway wherein the support body includes at least one protuberance extending generally outwardly thereof and adapted to be embedded within roadway material placed about the support body during a roadway resurfacing operation so that the securement of the support body within the manhole frame is enhanced.

17. The support as defined in claim 16 wherein the protuberance includes an aperture therein for accepting roadway material spread over the protuberance during a resurfacing operation.

18. The support as defined in claim 13 wherein the passageway has an entrance which opens generally toward said one end of the shank and an exit opposite the entrance, said portion of said shank protrudes out of the passageway exit and the support further comprises a nut threaded upon said portion of the shank and tightenable against the passageway-providing means as the nut is rotated in one direction about the threads of the shank.

19. The support as defined in claim 18 wherein the nut is a break-away nut having threads which are adapted to strip about the threads of the shank when the passageway-providing means is forced against the break-away nut by the rotatable body.

20. A manhole cover support cooperable with a manhole frame having an upwardly-opening recess within which a manhole cover is positionable for supporting the manhole cover in an elevated condition with respect to the frame, the manhole support comprising:

a support body receivable by the upwardly-opening recess of a manhole frame including a ring portion having a gap along one side thereof and a keeper strip portion attached to the ring portion so as to extend for an appreciable distance therearound and so that one section of the keeper strip extends across a portion of the gap from one side thereof and another section of the keeper strip portion extends across a portion of the gap from the other side thereof; and means for adjusting the outer dimension of the support body including:

a) means defining a first internally-threaded opening fixedly joined to said one section of the keeper strip portion adjacent the inside surface thereof;

b) means defining a second internally-threaded opening fixedly joined to said another section of the keeper strip portion adjacent the inside surface thereof; and c) an elongated threaded shank having one end which is threadably received by the first internally-threaded opening and another end which is threadably received by the second internally-threaded opening and the threads of the shank ends band said openings cooperating with one another so that when the shank is rotated in one rotational direction with said openings, the outer dimensions of the support body are increased, and said one and another sections of the keeper strip portion are deformable as the outer dimensions of the support body are increased so that the first and second internally-threaded openings and the shank are maintained in a substantially linear orientation as the outer dimensions of the support body are increases as aforesaid, and wherein the keeper strip portion has a periphery including a major section having a curvature which generally conforms with that of a circle encompassing the outer periphery of the support body and each of said one and another sections of the keeper strip portion are bent inwardly of said circle.

21. The support as defined in claim 20 wherein the threads of the first and second internally-threaded openings spiral along the corresponding opening-defining means in opposite directions so that rotation of the shank in one rotational direction relative to the opening-defining means effects a spreading apart of the opening-defining means.

* * * * *